US008813953B2

(12) United States Patent
Wegener et al.

(10) Patent No.: US 8,813,953 B2
(45) Date of Patent: Aug. 26, 2014

(54) TRANSPORTABLE ARRANGEMENT COMPRISING A PACK OF INSERTION ENVELOPES LYING FLAT AGAINST ONE ANOTHER AND A PACKAGING

(75) Inventors: Michael Wegener, Alfeld/Leine (DE); Friedhelm Wegener, Rheden (DE); Andreas Wenzeck, Alfeld/Leine (DE)

(73) Assignee: AWA Couvert GmbH (DE)

( * ) Notice: Subject to any disclaimer, the term of this patent is extended or adjusted under 35 U.S.C. 154(b) by 0 days.

(21) Appl. No.: 12/601,850

(22) PCT Filed: May 27, 2008

(86) PCT No.: PCT/EP2008/056473

§ 371 (c)(1),
(2), (4) Date: May 24, 2010

(87) PCT Pub. No.: WO2008/148665

PCT Pub. Date: Dec. 11, 2008

(65) Prior Publication Data

US 2010/0224509 A1 Sep. 9, 2010

(30) Foreign Application Priority Data

Jun. 7, 2007 (DE) ..... 10 2007 027 001

(51) Int. Cl.
*B65D 85/62* (2006.01)
*B65D 71/14* (2006.01)

(52) U.S. Cl.
CPC ..... *B65D 71/14* (2013.01); *B65D 2571/00839* (2013.01); *B65D 2571/00635* (2013.01); *B65D 85/62* (2013.01)
USPC ..... 206/215; 206/214; 206/451; 229/69; 229/87.05

(58) Field of Classification Search
USPC ..... 206/214, 215, 451, 449, 425, 499; 229/69, 87.05, 103.2, 236, 200, 244, 229/243
See application file for complete search history.

(56) References Cited

U.S. PATENT DOCUMENTS

| | | | | |
|---|---|---|---|---|
| 3,450,332 | A * | 6/1969 | Padovano | 206/149 |
| 3,579,944 | A | 5/1971 | Heywood et al. | |
| 4,830,186 | A * | 5/1989 | George et al. | 206/449 |
| 5,941,389 | A * | 8/1999 | Gomes | 206/427 |

(Continued)

FOREIGN PATENT DOCUMENTS

| | | |
|---|---|---|
| EP | 1 160 170 | 5/2001 |
| EP | 1 352 845 | 10/2003 |
| EP | 1 731 433 | 12/2006 |
| WO | 2004106192 | 12/2004 |

*Primary Examiner* — Anthony Stashick
*Assistant Examiner* — Robert Poon
(74) *Attorney, Agent, or Firm* — Salter & Michaelson

(57) ABSTRACT

A transportable arrangement that includes a plurality of stuffing envelopes adjoining each other in planar manner and a packaging therefor. A cover body made of cardboard-like material surrounds the plurality of stuffing envelopes. The cover body surrounds the plurality of stuffing envelopes on the bottoms thereof, the tops thereof and both end sides completely or partially. The narrow sides are left open. The cover body comprises two rectangular panes, designed relatively stronger than the other components of the cover body and resting on the end sides. The cover body comprises a tear tab that is arranged on one of the end sides of the plurality of stuffing envelopes. This allows the cover body to be torn open and the cover body to be pulled off the plurality of stuffing envelopes.

32 Claims, 4 Drawing Sheets

(56) References Cited

U.S. PATENT DOCUMENTS

| | | | | |
|---|---|---|---|---|
| 6,092,664 | A * | 7/2000 | Bartosek | 206/784 |
| 6,612,482 | B2 * | 9/2003 | Ross | 229/103.2 |
| 6,663,100 | B2 * | 12/2003 | Crowley | 271/165 |
| 7,225,924 | B2 * | 6/2007 | Hanson et al. | 206/451 |
| 7,344,021 | B2 * | 3/2008 | Muraro | 206/214 |
| 2006/0053754 | A1 | 3/2006 | Carrigan et al. | |
| 2006/0081485 | A1 | 4/2006 | Muraro | |

* cited by examiner

TRANSPORTABLE ARRANGEMENT COMPRISING A PACK OF INSERTION ENVELOPES LYING FLAT AGAINST ONE ANOTHER AND A PACKAGING

TECHNICAL FIELD

The invention relates to a transportable arrangement comprising a pack of insertion envelopes lying flat against one another and a packaging therefor, in which the pack has an underside formed by the lower longitudinal edges of the envelopes arranged in parallel adjacent rows, an upper side formed by the upper longitudinal edges of the envelopes arranged in parallel adjacent rows, two narrow sides formed by the side edges of the envelopes arranged in parallel adjacent rows and arranged perpendicularly to the underside and the upper side, one end side formed by an address side of a first insertion envelope of the pack, and another end side formed by a flap side of a last insertion envelope of the pack.

BACKGROUND OF THE INVENTION

Insertion envelopes are envelopes for letters and documents which are automatically filled with content in inserter machines. This means that they must be processed automatically in a very large numbers in very rapid succession. It is important in this case that the empty insertion envelopes to be filled are fed perfectly constantly in the same alignment, so that the filling mechanism provided in the inserter machine can also operate accordingly without occurrence of stoppages. Such stoppages would be extremely expensive, since they cause the entire filling and insertion process to stop and the personnel must intervene manually.

If such an insertion envelope to be filled is cause for such a stoppage, it is generally the case that not only the envelope itself but also the provided contents are crumpled or destroyed and the associated document or letter must therefore possibly be completely newly prepared. Since this must occur out of sequence and it must also be checked which document is concerned, significant additional costs arise here that are completely disproportionate to the actual value of the insertion envelope.

To ensure the subsequent feed of insertion envelopes for further processing, the supplied envelopes must be placed on a feed belt or in a feed channel, and in such a way that the feed mechanism can then perform the mentioned alignment simply and reliably. The insertion envelopes are then automatically conveyed on this feed belt or in this feed channel into the inserting machine and are filled and further processed, there.

Insertion envelopes are conventionally packed in cardboard boxes made of grey board or corrugated cardboard. As a result, a certain number of 750, 800 or 1000 envelopes, for example, can be respectively protected in one cardboard box and transported on pallets. In each case the operator of the inserter machine takes a cardboard box, opens it, removes the envelopes by gripping the outermost envelopes from the outside with his two hands and firmly holding them between his hands, placing the thus obtained stack onto the feed band or into the feed channel of the feed mechanism, placing them against the preceding envelopes and then disposing of the now empty cardboard box.

This handling is relatively expensive, since the opening of the box and the removal requires time. The respective gripping of the stack of envelopes dependent on the operator between two hands has the risk of mishandling actions and in individual cases can also cause some envelopes to be bent, so that the entire cycle of the inserter machine is stopped for this reason. The disposal process for the cardboard boxes that are still quite bulky even in empty state is also troublesome, since in this state they occupy a relatively large amount of space and therefore there quickly result stacks of boxes that are difficult to handle.

So-called Post Boxes have come into use for insertion envelopes as an alternative. These Post Boxes actually serve to transport conventional filled letter envelopes by Deutsche Post AG, for example, but can also be used to temporarily accommodate insertion envelopes. These Post Boxes form a type of upwardly open trough, into which an operator of the inserter machine or possibly also an automated device can reach and remove the stack of insertion envelopes and place them into the feed channel or onto the feed belt of the feed mechanism of the inserter machine.

These Post Boxes are made of plastic and are reusable and, as mentioned, can also be used for other purposes, which keeps the piece numbers high and therefore the production and storage costs within feasible limits despite the very complex structure. Because of their shape, they can be stacked in a relatively space-saving manner, however, these Post Boxes also take up a relatively large amount of space and are also heavy after emptying and are still comparatively expensive to produce.

As an alternative to these Post Boxes, cardboard packaging arrangements are proposed in patents EP 1 160 170 A2 and EP 1 731 433 A1, which like the Post Boxes are stackable and can be handled in a similar form. They have the advantage of being slightly more space-saving and also lighter both in empty and in filled state, and therefore also allow a more favourable transport and removal. These cardboard containers are also reusable and therefore environmentally friendly. This environmentally friendly aspect is further improved by the use of cardboard in the production instead of plastic.

A further possibility of packaging insertion envelopes is proposed in patent EP 1 352 845 B1. There, a stack of insertion envelopes is completely enclosed by an elastic film of plastic material over the short side edges of the envelopes, wherein two plastic panel members are additionally provided to reinforce the first and last envelope in order to increase stability and prevent the corners of the envelopes from bending over. The operator grips such a plastic packaging, lifts it up, laterally slits open the film, removes this, takes the plastic panel members and disposes of these separately and places the stack on the feed belt.

This proposal has the disadvantage that the handling is very complicated. In each case, the operator must slit open the film and remove the opened film while manually holding the packaging together with the envelopes over the feed belt. Thus, he only has his two hands for holding and slitting and therefore must have considerable dexterity to conduct this operation.

The operator could also try to press the envelopes out of the downwardly open plastic packaging. He also needs both hands for this, since he must hold the plastic packaging firmly and press the envelopes, and therefore requires considerable dexterity to simultaneously also correctly select the location to which the pressed out envelopes should then be directed. Moreover, this procedure results in a substantial risk of the corners or side edges of the pressed out envelopes being bent over or damaged or of the envelopes lying closest to the plastic panel members being caught on the plastic panel members, and there also being damaged and, therefore, disruptions to the operating cycle resulting.

The flaps of the insertion envelopes to be opened are also particularly at risk.

Moreover, the material is again plastic, i.e. a film-type plastic for the covering and also a thermoplastic for the reinforcement, which must be disposed of separately or must be further treated. If the thermoplastic used heats up during storage and transport, particularly because of the film-type plastic covering, then there can result distortions of the packaging and its contents and therefore bent envelopes that cannot be optimally aligned. Moreover, the sensitive upper and lower longitudinal edges of the envelopes in particular are unprotected.

Despite the different advantages of the possible packaging arrangements for insertion envelopes known from practice, therefore, there is still a requirement for further proposals to allow as secure and reliable a supply as possible of such insertion envelopes to inserter machines.

SUMMARY OF THE INVENTION

This object is achieved according to the invention with an arrangement of the above type in that the pack of insertion envelopes is surrounded by a hood unit made of a cardboard-type material, which completely or partially surrounds the packs of insertion envelopes on their underside, their upper side and around the two end sides and leaves them exposed on the narrow sides, that the hood unit contains two pressure-resistant rectangular panel members, which are arranged on the other components of the hood unit so that they lie on the two end sides of the pack of insertion envelopes, that the two rectangular panel members are configured to be relatively stronger than the other components of the hood unit, and that the hood unit has a tear-open flap, which is arranged on one of the end sides of the pack of insertion envelopes and allows the hood unit to be torn open and the hood unit to be pulled off the pack.

The fundamental idea of the invention is to use a cardboard strip with a width that corresponds approximately to the width of a inserting envelope and preferably has a slightly smaller width, wherein this cardboard strip surrounds the pack of the insertion envelopes to be packaged on the long sides of the envelopes in the manner of a cardboard box with two missing sides and at the same time covers it in a similar manner to a hood. The total length of this cardboard strip in relation to this cardboard sheet is slightly longer than the sum of the four sides of the pack of the insertion envelopes to be packaged that are to be enclosed by the hood unit. At the end side of the resulting stack, the slight overlap resulting from this extension can be provided with an adhesive strip specially shaped for closure and single tear off and preferably provided with a gripping element.

However, a different adhesive arrangement or connection is also possible to form the tear-open flap.

The optionally provided gripping element is preferably made of a flat, non-elastic and hand-friendly material, in particular a material that does not tend to cut into the hand. An elastic material with similar properties is also possible.

A possible material for this purpose is a polyethylene, a polypropylene or also a fibre-reinforced plastic such as a material available under the trade mark Tyvek®.

The gripping element can also be provided in the form of a larger sticker. This sticker can be glued to the outermost edge of the cardboard strip so that it projects beyond this, is folded over 180° and thus comes to lie on both sides of the cardboard strip. As a result of this, the operator no longer needs to grasp the grey board of the cardboard strip, but simply grasps this sticker on both sides and pulls it.

Such stickers can also be used for quite different purposes and for instance provide an indication of the manufacturer of the envelopes or of a type or sort of packaged envelopes, and therefore simultaneously fulfil a dual purpose.

The entire packaging, i.e. the cardboard strip with all the elements of the hood unit and also the panel members, can be disposed of as paper; one exception is possibly the gripping element if Tyvek or another material that is not made of a cellulose base substance is used for this. However, then there is at least the advantage that the entire packaging can be taken as one element and further treated jointly, for instance to be directed to a subsequent material separation outside the area of the inserter machine, and therefore does not take up the available space in this area.

This simplified disposability in the case of a preferred embodiment as pure paper material is not only extremely environmentally friendly, but is also economically very advantageous, since no additional measures have to be taken for removal of the residual substances. With the current demand for cellulose base substances, the paper and cardboard waste that occur according to the invention and are still to be disposed of are even disposable against remuneration, which further improves economic efficiency. The environmentally friendly aspect is further increased if recycled cardboard is respectively used for the cardboard strip of the hood unit and for the two rectangular panel members. It is additionally economical that possibilities for disposing of paper are provided in any case in mail processing installations. Therefore, an additional disposal system does not have to be created.

In contrast to conventional boxes made of plastic or other possible packaging arrangements using plastic material for insertion envelopes, the packaging element can be made completely or predominantly from cellulose and be disposed of in the paper cycle. Therefore, the packaging consists quite substantially of renewable raw materials and is environmentally friendly overall.

Contrary to the case with plastic packaging or also other reusable boxes, panel members and the like, it is not necessary to organise return transport and to convey the parts no longer required to this return transport. This also means that the parts otherwise to be provided for the return transport do not have to be checked to determine whether they can actually be reused again, no replacement production has to be organised and conducted and these parts do not have to be treated gently and carefully either. Therefore, the total expenditure in terms of cost, personnel and time incurred for a reusable packaging part is completely eliminated without any associated disadvantages to its durability or environmentally friendly nature, since according to the invention only materials that can be disposed of without problem are used.

The resulting protection is practically like in conventional boxes or cartons capable of protecting the insertion envelopes on the underside, the two end sides and additionally on the upper side against dust, moisture and other environmental influences, since it is surrounded on all sides by the respective hood unit. Since this is made of board or cardboard, the heat and moisture of the production process can radiate or evaporate off much better.

Besides the surrounding main component or composite of the cardboard strip resembling a cardboard box with two missing sides, the hood unit has two sufficiently rigid rectangular panel members. The two sufficiently rigid cardboard panel members have the size and shape of the insertion envelopes and in this way support the two ends of the stack to be packaged in the precise shape.

This hood unit encloses the stack, but leaves the narrow sides of the stack with the side edges of the envelopes free.

The transportable arrangements are structured bundle-like in tiers on the pallet. It must be taken into consideration that the packs of insertion envelopes are not respectively carried to the inserter machines as individual arrangements, but are generally stacked on pallets in large bundles. Therefore, there are then numerous stacked packaging units arranged one on top of the other. Moreover, an improved foothold of the envelopes on a pallet results because of the provision of the hood units according to the invention. Therefore, in this case the stable hood units with cardboard sections and with the panel members in vertical and horizontal direction lead to a defined additional protection of the individual packs of insertion envelopes in the large bundles on the pallet.

The design according to the invention allows a firm stack structure and a strength and stability defined by the pressure to be achieved.

The hood unit forms a hollow body, since it has a plurality of cardboard regions folding 90° to one another. Added to this are the rectangular panel members. The hood unit therefore constitutes two U profile sections placed one inside the other in contrary direction with section sides of different thickness. Overall, there results a three-dimensional, stabilising profile, as a result of which the thickness of the panel members can be kept relatively small.

A further very significant advantage is that the steam components contained in the just finished insertion envelopes that are still relatively moist and warm after packaging can evaporate via the side and end surfaces of the packaged arrangement with the insertion envelopes. In this way, the envelopes retain their dimensional stability predetermined during production and thus also their quality on the way to the user.

Punched out sections can be optionally provided in the hood unit with the panel members and/or in the tear-open flap or the gripping element. These punched out sections allow the operator or user at the inserter machine to remove the envelopes from the packaging and their packaging parts with particularly comfortable hand movements.

The gripping element could also be provided by an accordingly suitable punched out section in the hood unit. The hood unit can also form the gripping element by integrally formed or glued projections with punched out sections.

With these measures it should be considered that the "fixed" side of the gripping element should be fastened with a comparatively strong adhesive joint to the hood unit, whereas the connection to be detached located on the side below the gripping medium should be relatively easy to open.

Moreover, it is preferred if the hood unit is provided with additional reinforcing strips.

A particularly preferred embodiment is distinguished in that the reinforcing strips are provided in the regions, at which the hood unit runs from the underside of the pack of insertion envelopes and is bent upwards by 90° around one of the two end sides, and that the reinforcing strips run transversely to the sheet of the hood unit, i.e. parallel to the lower longitudinal edges of the envelopes.

As a result of this, the load is relieved from the section in particular which is subjected to the heaviest load during transport and at which the hood unit bends upwards from the underside of the arrangement at an angle of 90° and runs along the end sides.

This has provided a simple possibility for additional protection that does not impair the further advantageous possibilities in the least. A simple adhesive strip made of a plastic or preferably a fibrous cellulose material can be glued in place as edge protection, as it were, that extends transversely over the hood unit from one side edge to the other side edge and is glued precisely to the edge resulting here.

The reinforcing strip or strips can be applied to the hood unit from outside or also from inside from the sides adjacent to the envelopes.

It is also sufficient to only provide the regions directly adjoining the side edges with short sections of such reinforcing strips, since the prevention of tearing from the side edge is already completely sufficient as protection.

A further possibility is that the hood unit is provided with alternative or additional reinforcing strips, that the reinforcing strips runs on the hood unit along its side edges, and that a respective reinforcing strip is provided on both side edges adjacent to the edge of the hood unit.

In comparison to conventional cardboard boxes or other trough- or tray-like packaging arrangements and receptacles for insertion envelopes, a further aspect arises according to the invention that now becomes very interesting. Thus, there is a constantly increasing requirement with respect to possible fires in association with inserter machines and corresponding processing machine for despatching envelopes with contents in particular. Since relatively readily flammable materials such as paper and plastic are processed by machines here, there is therefore the risk of a fire also occurring in the event of a malfunction. Therefore, corresponding areas are usually equipped with sprinkler systems or other extinguisher systems that ensure that water is discharged from the ceiling onto the regions located below.

However, if the insertion envelopes are housed in trough- or tray-like containers, while the water will fall from above through the sprinkler system or other wetting system into the uppermost of the tub- and trough-like containers, the water will remain in precisely this container and is therefore no longer available for further extinguishing measures. While a fire in the respective uppermost container can be extinguished or prevented in this way, since all the water will collect in this container, a fire in the tiers of the stacked insertion envelopes located below this will remain practically unaffected by the sprinkler system, since the water can no longer penetrate, or at least not quickly enough, down into these regions.

For this reason, it has already been attempted in the prior art in the case of tub-like packaging arrangements to equip the corresponding containers with holes and bores, through which water can flow downwards. However, there remains a quite substantial delay in the corresponding sprinkler system becoming effective.

This problem does not even arise in the packaging arrangements for the insertion envelopes according to the invention. Firstly, the packaging components arranged around the envelopes are made of cardboard and therefore water can quickly penetrate through them, and secondly these packaging components are not trough- or tray-like either and therefore water is not collected in them, but can penetrate directly into the sections with further insertion envelopes located underneath.

This is very interesting in particular for the substantial insurance fees that have to be made for such premises and inserter systems, since these can reach significant amounts in view of the possible risks and the value of the entire installations.

In association with reducing the effects of any fires, it should also be noted that the arrangements provided according to the invention use insertion envelopes that are relatively closely compressed because of the hood unit. Compared to loose non-compacted paper, compressed paper has a much smaller paper surface available for the oxygen of the air to act on. Therefore, if the oxygen cannot reach the paper surface, the correspondingly compressed paper cannot burn or a fire that occurs can only be propagated substantially more slowly or poorly. Therefore, the insertion envelopes compressed in the arrangements according to the invention only catch fire in a delayed manner compared with loose non-compacted paper such as is present in conventional transport boxes in the form of the insertion envelopes placed therein.

It is also highly advantageous in this context that the arrangements according to the invention are effective without or with extremely few plastic components. When plastic burns, for example, a mixture containing hydrochloric acid or gas containing hydrochloric acid is formed from the frequently used polystyrene. Both of these are damaging to health and are corrosive not only for people but also for the respective machines and systems in the area. This also leads to increased insurance premiums when such materials are used.

Other reaction products can also be formed during burning processes with the respectively used plastics, and this can lead to a variety of problems.

A further economic advantage that arises in association with the invention is also technically attributable to the insertion envelopes being packed and pressed much more closely together according to the invention than occurs with conventional transportable arrangements comprising insertion envelopes with their packaging. Namely, the envelopes require significantly less storage space in this way. In the closely packed and compressed state, the number of envelopes that can be stored in a specific space in a storage area is substantially higher than those in loose non-compacted state. A significant saving in storage space is possible.

A similar advantage arises in transport operations. The space in loading areas of a truck or truck trailer, for instance, or other transport means such as containers or railway wagons, for instance, can be utilised in a significantly better manner with the closely packed and compressed insertion envelopes according to the invention. In general, the weight of the envelopes to be transported is not so high that it causes the capacities of the transport vehicles to be utilised completely or almost completely, and therefore the additional quantity of envelopes that can be transported in the same space does not lead to any overloading of the transport means whatsoever. Since the costs for a transport are generally dependent on the volume of the goods to be transported, then the transport is significantly more economical. At the same time, it is also more environmentally friendly, since the same quantity of envelopes can be transported with fewer transport means.

DESCRIPTION OF THE DRAWINGS

An exemplary embodiment of the invention is described in more detail below on the basis of the drawing.

DETAILED DESCRIPTION

Figure 1:
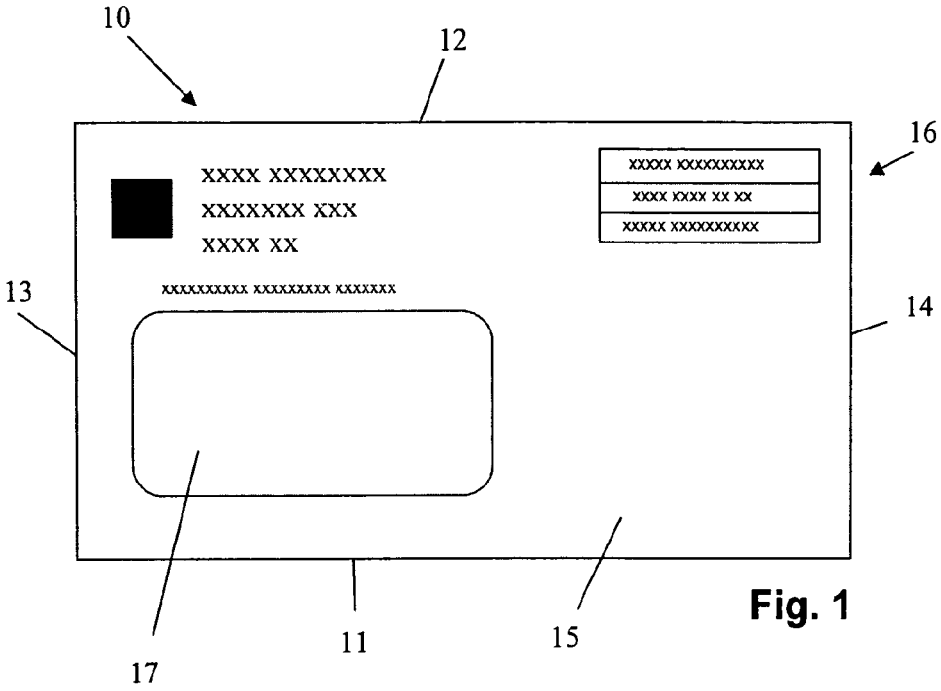
FIG. 1 shows an inserting envelope.

A inserting envelope 10 shown in FIG. 1 is used to despatch letters or documents. It is approximately rectangular and has a lower longitudinal edge 11, an upper longitudinal edge 12 parallel to the longitudinal edge, two side edges 13 and 14 perpendicular to the two longitudinal edges and, moreover, a plane side that forms the address side 14, and a flap side 16 remote from the address side 15. The address side 15 can possibly have a window 17. A letter or another document located in the inserting envelope 10 with an address of an intended recipient can be seen and evaluated through the window 17 by a mail despatch company. The flap side 16 concealed in FIG. 1 and remote from the observer is used to be able to automatically open the envelope, place the letter or the document and any enclosures provided in the envelope 10 and close this after insertion.

Such insertion envelopes are processed by machine and must be fed manually or automatically to corresponding inserter installations (not shown) in very large numbers.

The feed is conducted by the insertion envelopes 10 being placed in large numbers onto a corresponding guided belt, which then feeds the envelopes 10, generally arranged vertically, to an automatic filling machine (not shown). In other types of inserter machines the insertion envelopes are inserted into vertical shafts. To be able to lay the envelopes 10 on these conveyor belts or insert them into these feed channels in large numbers in a relative short time, the envelopes 10 are firstly arranged into a pack 20 of insertion envelopes arranged upright or lying flat next to one another. This configuration is implemented at the manufacturers of the insertion envelopes 10. The stack thus formed is then suitably packaged and held together so that it forms an object that can be handled during transport and storage and afterwards can be placed in as compact a form as possible and without problems onto the conveyor belt of the inserter machine.

Figure 2:
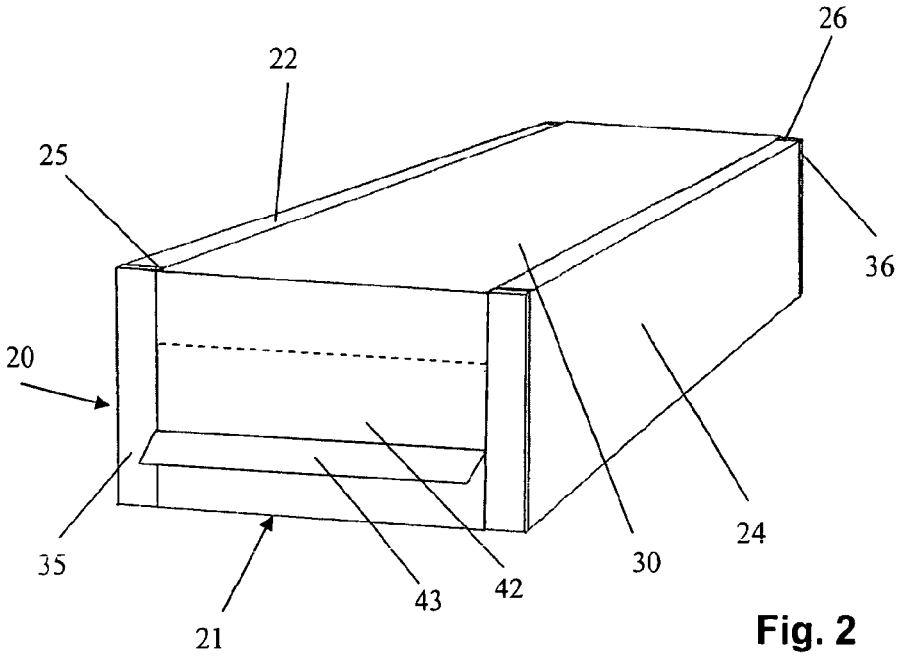
FIG. 2 is a schematic perspective representation of an embodiment of the invention in unopened state.

While carton-like containers are usually used in the prior art for this purpose, from which the insertion envelopes 10 are then removed and placed onto the conveyor belt or into the conveyor shaft by hand, in the embodiment according to the invention shown in FIG. 2 a pack 20 of insertion envelopes 10 is packaged differently. In this case, the pack 20 has an underside 21, which is formed by the lower longitudinal edges 11 of the numerous envelopes 10 of the pack 20 arranged next to one another. A pack 20 can comprise, for example, 750, 800 or 1000 insertion envelopes 10, other numbers also being possible, however.

Since the pack 20 is formed from numerous insertion envelopes 10 lying flat, or more precisely expressed arranged upright, next to one another, not only the lower longitudinal edges 11, but also the upper longitudinal edges 12 of the individual envelopes 10 are then arranged parallel to one another and next to one another and jointly form an upper side 22 of the pack 20 of insertion envelopes 10.

The likewise parallel side edges 13 and 14 of the insertion envelopes 10 then form the narrow sides 23 and 24 of the pack 20 that are parallel to one another and perpendicular to the underside 21 and the upper side 22.

A first end side 25 of the pack 20 facing the observer in FIG. 2 is formed by the address side 15 of the first envelope 10 of the pack 20. The address side 15 of the first envelope 10 is not visible in FIG. 1 because is it covered in a form to be described later.

The flap side 16 of the last envelope 10 of the pack 20 lies on the opposite end side 26 of the pack 20 remote from the view in FIG. 2.

In this illustrated state, the envelopes 10 are arranged upright just as on the feed belt of an inserter machine. Therefore, these are envelopes 10 "arranged upright next to one another" to be more precise.

This pack 20 is then enclosed by a hood unit 30. The hood unit 30 of a cardboard-like material is directed peripherally around the pack 20 of insertion envelopes 10. It begins on the front end side 25, goes over the underside 21, around the rear end side 26 and over the upper side 22 to the front end side 25 again.

The two ends of the hood unit 30 overlap on the front end side 25. In the region of the overlap the two ends can be connected, in particular glued, to one another.

Moreover, a tear-open flap 42 is arranged on the end of the hood unit 30 facing the observer. The tear-open flap 42 and/or the grip 43 can be configured in one piece with the hood unit 30; this can also be a different particularly grip-friendly material that in particular does not cut into the hand of a user when pulling hard on the grip 43 or the tear-open flap 42.

When not in use, the tear-open flap 42 with the grip 43 lies flat on the end side 25 of the pack 20 of insertion envelopes 10.

The user takes this pack 20 with the hood unit 30 from a stack on a pallet, for example, and lays it on the conveyor belt of the inserter machine. In this case, it should merely be ensured that the end side 25 is orientated the correct way round, which can be easily seen by the arrangement of the tear-open flap 42.

Also of advantage to the user in this case is if, as provided in the shown embodiment, the hood unit 30 does not reach quite as far as the side edges 13 and 14 of the envelopes 10, i.e. already leaves a small section of the upper side 22 free in front of the narrow sides 23 and 24. Namely, this means that an experienced user can still ascertain from the appearance of the upper side 22 whether he is looking at a small section of the address side 15 or the flap side 16 of the envelope 10. Namely, the address side 15 and the flap side 16 have an optical difference for the experienced user in that a small piece of the flap can still be recognised in this region close to the edge.

However, it would also be possible (not shown) to machine transparent or also punched-through perforations into the hood unit 30 in this region that allow a view onto the first envelope 10 arranged behind these and a characteristic section thereof, possibly onto an edge region of the flap or the window cut-out section.

It is then not necessary according to the invention to provide special imprints to identify the correct orientation. This additionally simplifies the use of the arrangement according to the invention.

At this stage, the pack 20 is still surrounded by the hood unit 30 in particular. Therefore, it cannot be processed further yet. However, since the feed belt of the inserter machine also still has the envelopes 10 from the preceding packs 20 that are still being fed to the inserter machine, the user has a few seconds to now conduct the next steps.

Figure 3:
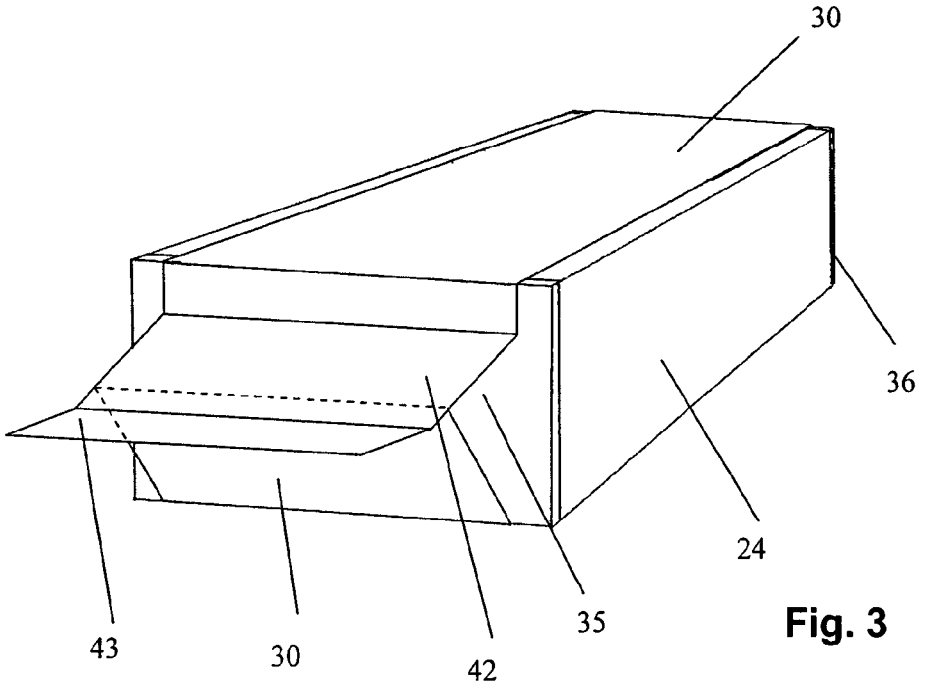
FIG. 3 is a perspective representation comparable to FIG. 2 of the embodiment shown directly after a tear-open flap is torn open.

This is indicated in FIG. 3. The user pulls the grip 43 of the tear-open flap 42. As a result of this, the adhesive joint of the hood unit 30 tears open and this can be moved upwards at one end, so that it becomes detached and removed from the end side 25 and the upper side 22 of the pack 20 of insertion envelopes.

With a strong pull on the tear-away flap 42 by means of the grip 43, the cardboard-like material of the already torn open hood unit 30 can be pulled out under the underside 21 of the pack 20 of insertion envelopes 10 without the longitudinal edges 11 of the envelopes 10 being damaged thereby or their arrangement being brought into disarray.

The now "last end" of the hood unit 30 projecting under the pack 20 can still be seen in FIG. 3 on the side of the pack 20 facing the observer.

The cardboard-like material of the now no longer needed hood unit 30 can be disposed of as normal cellulose-containing material and thus occupies much less space compared to conventional empty cartons after the removal of insertion envelopes.

It is already evident in FIG. 3 that on the side adjacent to the envelopes 10 the hood unit 30 comprises two pressure-resistant rectangular panel members 35, 36, which completely cover the two end sides 25 and 26 of the pack 20 of insertion envelopes 10.

The rectangular panel members 35 and 36 can also be referred to as slabs. They can be made thicker than the other components of the hood unit 30 and ensure that the pack 20 of insertion envelopes 10 is protected at the two end sides 25 and 26 during the entire transport and storage operations and in particular the outer corners of the outer envelopes 10 are not folded or bent, which would render processing in an inserter machine very difficult or possibly exclude this.

Figure 4:
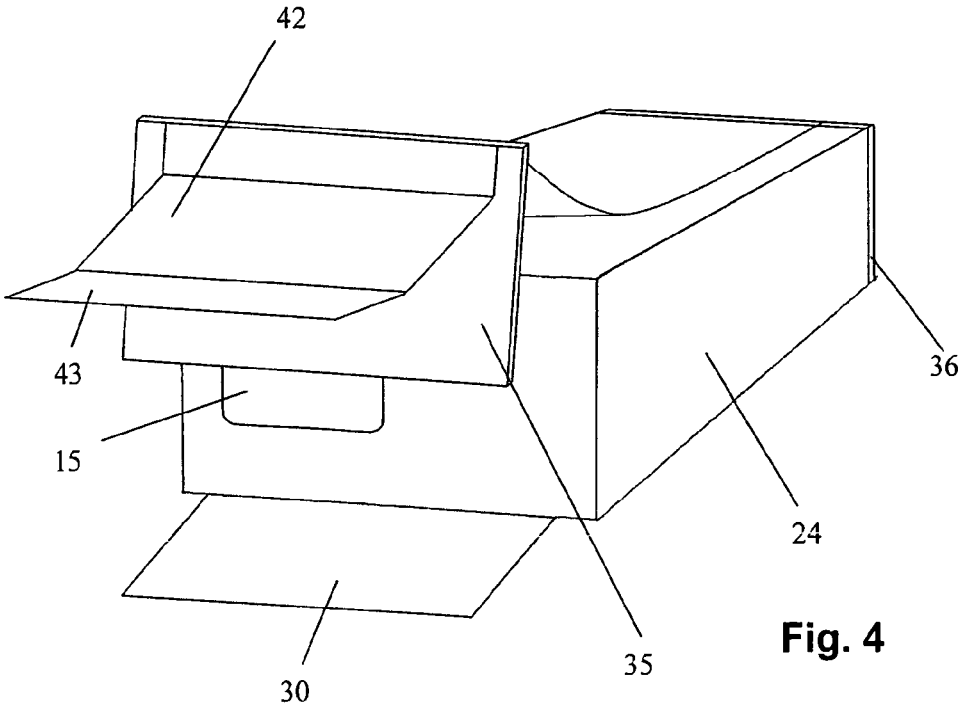
FIG. 4 is a perspective representation comparable to FIG. 2 of the embodiment shown during further progress in the opening process.

A look at FIG. 4 now shows the next step during processing in an embodiment. The user or operator now lifts the front side of the hood unit 30 by its panel member 35 with the grip 43 and takes this off the pack 20 of insertion envelopes 10.

The situation in FIG. 4 shows how the front panel member 35 now frees the view onto the address side 15 of the first envelope 10 of the pack 20.

A provision in the preferred embodiment shown in FIG. 4 is to connect the hood unit 30 to its panel members 35, 36 and in this way separate them from the envelopes 10 after tearing open the tear-open flap 42 by means of the grip 43. This connection would preferably be provided in a region on the edges of one of the two panel members 35 and 36.

FIG. 4 shows the section of the hood unit 30 that is connected to the panel member 35 and is already lifted slightly upwards with the panel member 35 after tearing open, and in a similar manner to FIG. 3, the last end that now still lies flat and projects under the pack 20 that is pulled through under the underside 21 in the next pulling action.

The second panel member 36 of the hood unit 30 is then pulled upwards with this "last end" on the side of the pack 20 remote from the observer and thus also separated from the envelopes 10.

The hood unit 30 with its panel members 35, 36 can be simply transported away in the paper disposal operation. They likewise occupy only little space. In contrast to empty cartons, there is no resistance as a result of being spatially inserted one inside the other.

The hood unit 30 with its two panel members 35, 36 is virtually flat in the state for disposal. With all its parts it is made completely or predominantly of pure cellulose material and does not have to be expensively additionally processed in the further disposal process. Moreover, both the hood unit 30 and its two panel members 35, 36 are preferably each made from a recycled board.

Thus, in the embodiment according to FIG. 4, only the pack 20 of insertion envelopes 10 without any hood units 30 or other packaging is still located on the conveyor belt during feed to the inserter machine and is perfectly further processable. In this case, the operator can still push this pack 20 against the other envelopes of the preceding stack. However, removal of the hood unit 30 does not take up much space and therefore scarcely any space between the two consecutive packs 20 of insertion envelopes 10 is necessary for this activity.

To provide a pack 20 of insertion envelopes 10 with the preferred packaging according to the invention that consists primarily of the hood unit 30, a modified form of the so-called packing presses used in the industry specialised in the production of letter envelopes can be used. Production can be conducted both automatically and manually or by a combination of both.

In this case, the procedure is approximately as follows: firstly, a conventional machine designed for the production of envelopes produces a pack 20 of insertion envelopes 10 in a desired and predetermined quantity of 750 or 1000 pieces, for example. This pack 20 is then guided by hand or automatically into a pressing device in non-compressed state. A panel member 35 is inserted as lower slab in front of the first envelope 10 of the pack 20 before, during or after this process and a part of the hood unit 30 is placed underneath. This lower slab then becomes the front panel member 35 or the front slab in the illustration in FIG. 4.

It is also optionally possible that the middle part of the hood unit 30 is attached in one piece or glued to this panel member 35.

The further panel member 36 is then laid on the last envelope 10 of the pack 20 as upper slab. This upper slab then becomes the rear panel member 36 or rear slab in the illustration in FIG. 4.

The envelopes 10 of the still non-compressed pack 20 are then pressed jointly with the upper panel member 36 against the already present lower panel member 35 with a pressure adjusted at the pressing device. The pressure on the pack 20 can also be optionally exerted using a plurality of different tools.

Side flaps are located in the region of the side edges 13 and 14 of the insertion envelopes 10. These side flaps are used in the production of insertion envelopes 10 to enable the address side 15 and the flap side 17 to be joined together. In this region, the pack 20 of insertion envelopes 10 is additionally compacted with a width of about 10 mm at maximum by pressing.

In a subsequent step the remainder of the hood unit 30 would then be fastened to one or both panel members 35, 36 by sharply folding and applying an adhesive. As a result, the hood unit 30 is complete and surrounds the entire pack 20, as required.

The hood unit 30 could also be formed from a prefabricated carton with sections of different thickness, wherein the thicker areas of the cardboard sheet then form the panel members 35, 36.

The packs 20 of insertion envelopes 10 are now ready for transport and are stacked on a pallet, and a large piece number of such packs 20 or arrangements comprising envelopes 10 and packaging 30 is then protected once again as in conventional transport operations, and the entire pallet is transported.

The insertion envelopes 10 in the packs 20 preferably have the same thickness on the lower longitudinal edges 11, the so-called base folding edge, as on the opposite upper longitudinal edge 12, on which the closure flap of the flap side 16 is articulated. This can prevent the formed packs 20 from being trapezoidal, since otherwise more paper layers can possibly come together at the closure flap than at the opposite lower longitudinal edge 11. This can be achieved by slightly lengthening the side flap blank and its fold.

Figure 5:
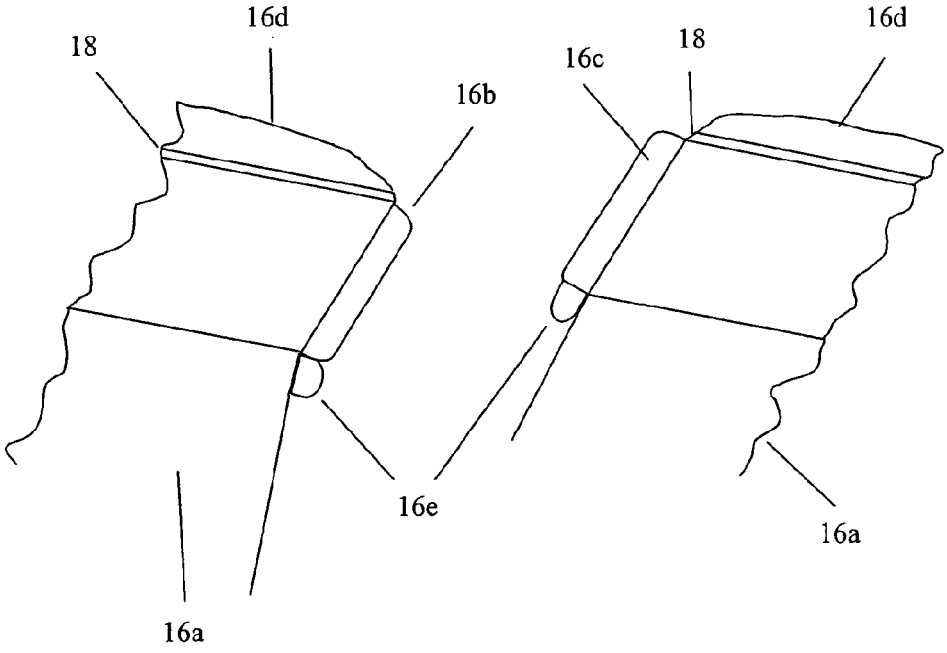
FIG. 5 is a more detailed representation of a preferred embodiment of a inserting envelope used.

To enable the envelopes 10 to be favourably processed further after removal from the pack 20, it has proved particularly advantageous to provide the envelopes 10 with a pre-creased erectioning fold 18. A more detailed illustration of an envelope 10 with this pre-creased erectioning fold 18 as well as the elements of the flap side 16 configured in accordance with these considerations are shown in FIG. 5. This shows a correspondingly schematically represented unfolded envelope 10, an address side 15 with flaps 16*a*, 16*b*, 16*c* and 16*d* articulated thereon that together form the flap side 16. Usual in this case are a base flap 16*a*, which is articulated to the lower longitudinal side 11, two side flaps 16*b* and 16*c*, which are respectively articulated to the two side edges 13 and 14, and also a closure flap 16*d*, which is articulated to the upper longitudinal edge 12.

As may be seen in FIG. 5, the closure flap 16*d* is articulated to the upper longitudinal edge 12 by means of the pre-creased alignment fold 18 that allows better opening in the automatic inserter machine.

It is also additionally indicated in FIG. 5 that small extra flaps 16*e* forming the additional paper layer are articulated at the bottom to the side flap 16*c* and/or the base flap 16*a*.

Figure 6:
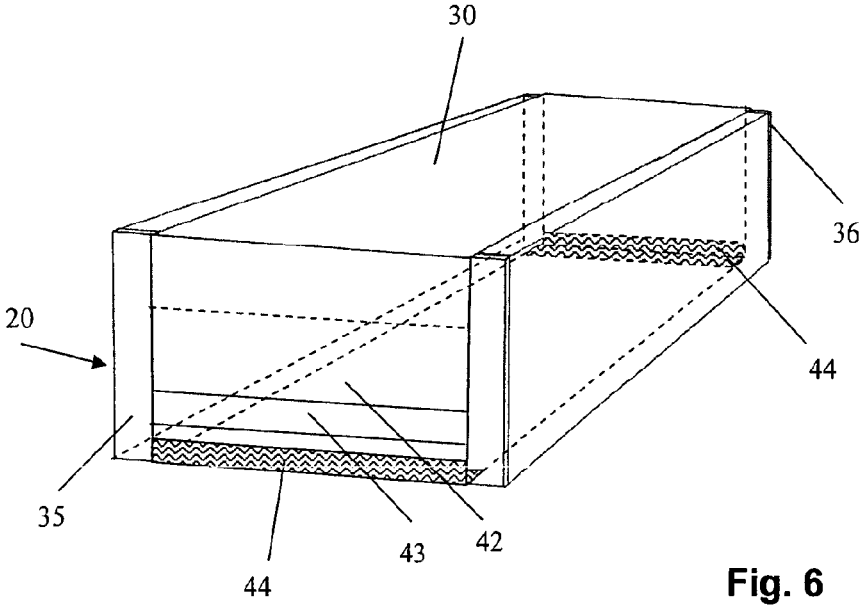
FIG. 6 is a representation similar to FIG. 2 in a slightly modified embodiment with reinforcing strips.

FIG. 6 shows an additional possibility for further improving the protection provided by the packaging.

In this case, one or more reinforcing strips 44, in particular adhesive strips, are glued on the hood unit 30. In the embodiment from FIG. 6, these adhesive strips run parallel to the lower and upper longitudinal edges 11 and 12 of the insertion envelopes 10 and are attached in the regions of the hood unit 30 where this is respectively folded 90°. This therefore relates to the edges that form the end sides 25 or 26 with the underside 21 and the upper side 22 of the pack 20.

Such adhesive strips or reinforcing strips 44 are provided in particular on the edges formed by the underside 21 with the two adjoining end sides 25 and 26. As a result, tearing of the hood unit 30 at these relatively sensitive regions can be prevented in the event of the entire arrangement being accidentally dropped or also during longer transport over unfavourable surfaces in a pallet. As a result, the hood unit 30 in particular is held together and allows removal in complete state when placed onto the conveyor belt during feed to the inserter machine.

It is also possible to direct these adhesive bands or reinforcing strips 44 only a slight distance from the side edge of the hood unit 30, as the edges or side edges are the most sensitive.

Figure 7:
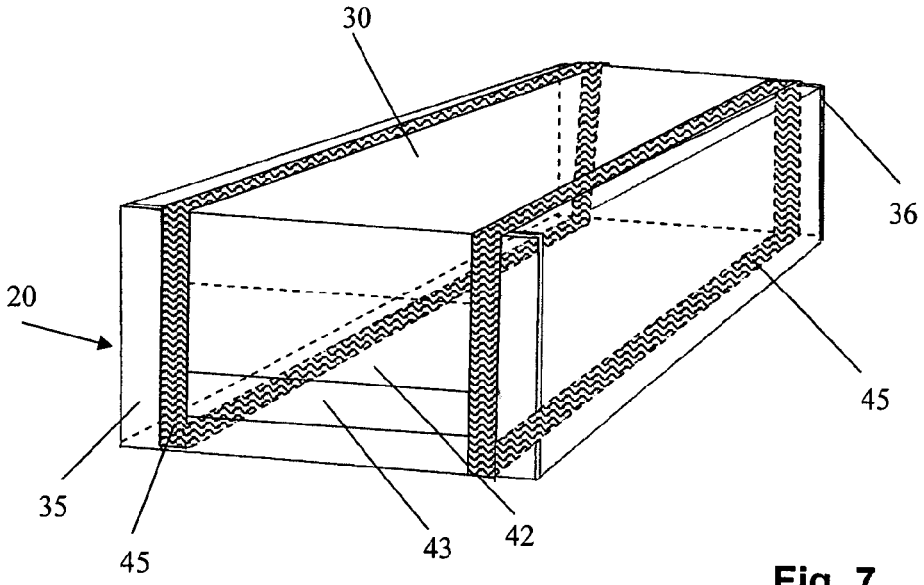
FIG. 7 is a representation similar to FIG. 2 in another modified embodiment with reinforcing strips.

It is shown in a further embodiment in FIG. 7 that adhesive bands or reinforcing strips 45 are also provided that are applied here along the side edges of the hood unit 30 and run right around. These reinforcing strips 45 also serve the same purpose and have the advantage of stopping any tearing of the side edge of the hood unit 30 overall.

A combination (not shown) of types of attachment of the reinforcement strips 44 and 45 from FIGS. 6 and 7 is also conceivable.

The reinforcing strips 44, 45 can either be attached to the hood unit 30 from the outside, as is also respectively indicated in FIGS. 6 and 7, but can also be attached to the hood unit 30 from the inside, i.e. to be located between the hood unit 30 and the pack 20 of insertion envelopes 10.

The adhesive bands or reinforcing strips 44, 45 are preferably made of a fibre-reinforced paper material.

If desired, it is additionally possible to insert additional cardboard layers that take up little space between the insertion envelopes 10, for example, to provide a division into sections of 300, 400 or 500 envelopes 10. Such cardboard partitions (not shown) can be an easy form of stabilisation if standing stability of the envelopes 10 is temporarily required after the tear-open flap 42 has been torn open. This can be of interest in some circumstances if the arrangements according to the invention are not to be laid on the belt in one work cycle, but in two or more work cycles, for example, because of reduced take-up capacity of the feed belts.

REFERENCE NUMERALS

10 inserting envelope
11 lower longitudinal edge

12 upper longitudinal edge
13 side edge
14 side edge
15 address side
16 flap side
16*a* base flap
16*b* side flap
16*c* side flap
16*d* closure flap
16*e* extra flap
17 window
18 pre-creased erectioning fold
20 pack of insertion envelopes
21 underside
22 upper side
23 narrow side
24 narrow side
25 end side
26 end side
30 hood unit
35 panel member
36 panel member
42 tear-open flap
43 grip
44 reinforcing strip horizontally on the end sides 25, 26
45 reinforcing strip longitudinally around the hood unit 30

What is claimed is:

1. Transportable arrangement comprising:

a pack of insertion envelopes lying flat against one another, said pack having an underside formed by the lower longitudinal edges of the envelopes arranged in parallel adjacent rows, an upper side formed by the upper longitudinal edges of the envelopes arranged in parallel adjacent rows, and two narrow sides formed by the side edges of the envelopes arranged in parallel adjacent rows and arranged perpendicularly to the underside and the upper side of the envelopes, said pack having one end side formed by an address side of a first inserting envelope of the pack, said pack having another end side formed by a flap side of a last inserting envelope of the pack, a hood unit comprising a continuous web made of a cardboard-type material, which surrounds the packs of insertion envelopes and contacts on the underside, the upper side and the one and another end sides of the pack in a compressed state, said continuous web having a width measured in a direction of a plane of each envelope that is less than the width of the pack as measured between the two narrow sides of the pack leaving respective exposed sides of the pack on either side of the continuous web width, two pressure-resistant rectangular panel members, which are constructed and arranged to be relatively stronger than the continuous web, said two pressure-resistant rigid rectangular panel members disposed at spaced apart locations along the continuous web so that the respective panel members abut the one and another end sides of the pack of insertion envelopes;

said hood unit further including a tear-open flap which is disposed at one of the end sides of the pack of insertion envelopes and with a pulling thereof allows the hood unit and panel members to be together torn open and pulled off the pack;

at least one of said pressure-resistant rigid rectangular panel members being permanently secured to the continuous web such that the web and the at least one panel member are together pulled away from the pack when pulling the tear-open flap.

2. Transportable arrangement comprising a pack of insertion envelopes according to claim 1, characterised in that the tear-open flap has a gripping element.

3. Transportable arrangement comprising a pack of insertion envelopes according to claim 2, characterised in that the gripping element is made of a tear-resistant and skin-friendly material.

4. Transportable arrangement comprising a pack of insertion envelopes according to claim 1, characterised in that the hood unit is made of a material containing cellulose.

5. Transportable arrangement comprising a pack of insertion envelopes according to claim 4, characterised in that the hood unit is made of cardboard.

6. Transportable arrangement comprising a pack of insertion envelopes according to claim 1, characterised in that the hood unit is arranged to run around the pack of insertion envelopes as a continuous web member, so that the two web ends overlap on an end side on one of the two panel members.

7. Transportable arrangement comprising a pack of insertion envelopes according to claim 6, characterised in that the tear-open flap is arranged in the region of the overlap.

8. Transportable arrangement comprising a pack of insertion envelopes according to claim 4, characterised in that the hood unit, the tear-open flap and, the gripping element are made from the same material.

9. Transportable arrangement comprising a pack of insertion envelopes according to claim 1, characterised in that the hood unit is provided with recesses for gripping during the opening process.

10. Transportable arrangement comprising a pack of insertion envelopes according to claim 1, characterised in that the envelopes are provided with pre-creased erectioning folds.

11. Transportable arrangement comprising a pack of insertion envelopes according to claim 1, characterised in that the hood unit and its two panel members are connected to one another so that they can be jointly pulled away after the tearing open process.

12. Transportable arrangement comprising a pack of insertion envelopes according to claim 11, characterised in that the two panel members of the hood unit arc glued to the other components of the hood unit.

13. Transportable arrangement comprising a pack of insertion envelopes according to claim 1, characterised in that the hood unit is provided with additional reinforcing strips.

14. Transportable arrangement comprising a pack of insertion envelopes according to claim 13, characterised in that the reinforcing strips are provided in the regions at which the hood unit runs from the underside of the pack of insertion envelopes, and is bent upwards by 90° around one of the two end sides, and that the reinforcing strips run transversely to the web member of the hood unit, i.e. parallel to the lower longitudinal edges of the envelopes.

15. Transportable arrangement comprising a pack of insertion envelopes according to claim 14, characterised in that the reinforcing strip or strips run right from one side edge of the hood unit to the other side edge of the hood unit, or that they project towards one another at least from both side edges of the hood unit a short distance perpendicularly to the side edge.

16. Transportable arrangement comprising a pack of insertion envelopes according to claim 13, characterised in that the reinforcing strips run along the hood unit on the side edges thereof, and that a respective reinforcing strip is provided on both side edges adjacent to the edge of the hood unit.

17. Transportable arrangement comprising a pack of insertion envelopes according to claim 13, characterised in that the reinforcing strips are made of a reinforced paper material and/or of plastic.

18. Transportable arrangement comprising a pack of insertion envelopes according to claim 14, characterised in that the reinforcing strips are adhesive strips.

19. Transportable arrangement comprising a pack of insertion envelopes according to claim 14, characterised in that the reinforcing strips are arranged on the outer surface of the hood unit remote from the envelopes, or that the reinforcing strips are provided on the inner surface of the hood unit facing the envelopes.

20. Transportable arrangement comprising a pack of insertion envelopes according to claim 1 wherein said hood unit comprises a continuous web that extends about the pack, and the width of the web member covers a majority of a width of the pack as measures in a direction along the length of the upper longitudinal edge of the envelopes.

21. Transportable arrangement comprising a pack of insertion envelopes according to claim 20 wherein the width of the web member is less than the width of the pack leaving the respective exposed sides on either side of the web member having a width less than the width of the web member.

22. Transportable arrangement comprising a pack of insertion envelopes according to claim 21 including an elongated substantially flat grip that is contiguous with said tear-open flap, and that has a free end edge for grasping by a user.

23. Transportable arrangement comprising a pack of insertion envelopes according to claim 22 wherein said grip extends substantially transverse to side edges of the envelopes.

24. Transportable arrangement comprising a pack of insertion envelopes according to claim 1 including a gripping element that is contiguous with said tear-open flap, and that has a free end edge for grasping and pulling by a user.

25. Transportable arrangement comprising a pack of insertion envelopes according to claim 24 wherein said hood unit comprises a continuous web that extends about the pack, and the width of the web member covers a majority of a width of the pack as measures along the length of the upper longitudinal edge of the envelopes.

26. Transportable arrangement comprising a pack of insertion envelopes according to claim 25 wherein the width of the web member is less than the width of the pack leaving the respective exposed sides on either side of the web member having a width less than the width of the web member.

27. Transportable arrangement comprising a pack of insertion envelopes according to claim 1 wherein both of the panel members are secured at spaced apart locations to the hood unit so that the hood unit and panel members can be together pulled away from the pack and disposed of.

28. Transportable arrangement comprising a pack of insertion envelopes according to claim 27 wherein said hood unit comprises a continuous web that extends about the pack, and the width of the web member covers a majority of a width of the pack as measures in a direction along the length of the upper longitudinal edge of the envelopes.

29. Transportable arrangement comprising a pack of insertion envelopes according to claim 27 including a gripping element that is contiguous with said tear-open flap, and that has a free end edge for grasping and pulling by a user.

30. Transportable arrangement comprising a pack of insertion envelopes according to claim 27 wherein both the panel members are permanently secured to the hood unit so that the web and panel members are together pulled away from the pack and disposed of.

31. Transportable arrangement comprising a pack of insertion envelopes according to claim 1, wherein the continuous web is of a fibrous cellulose material having multiple sections extending longitudinally and of different thinner and thicker thicknesses.

32. Transportable arrangement comprising a pack of insertion envelopes according to claim 31, wherein the thicker sections form respective panel members that are connected with the thinner sections.

* * * * *